US007422214B2

(12) United States Patent
Wong

(10) Patent No.: US 7,422,214 B2
(45) Date of Patent: Sep. 9, 2008

(54) METHODS FOR CHINESE RADICAL GAMES

(75) Inventor: Jacob Y. Wong, Goleta, CA (US)

(73) Assignee: Gamelot, Inc., Goleta, CA (US)

( * ) Notice: Subject to any disclaimer, the term of this patent is extended or adjusted under 35 U.S.C. 154(b) by 198 days.

(21) Appl. No.: 10/947,731

(22) Filed: Sep. 23, 2004

(65) Prior Publication Data

US 2006/0061038 A1 Mar. 23, 2006

(51) Int. Cl.
*A63F 3/00* (2006.01)

(52) U.S. Cl. ..... 273/272

(58) Field of Classification Search ..... 434/128, 434/129, 156, 157, 159, 160, 167, 171, 172, 434/176; 273/272, 299
See application file for complete search history.

(56) References Cited

U.S. PATENT DOCUMENTS

| | | | | | |
|---|---|---|---|---|---|
| 2,175,939 | A * | 10/1939 | Grudin | 434/160 |
| 2,682,118 | A * | 6/1954 | Larsen | 434/160 |
| 4,243,225 | A * | 1/1981 | Levinrad | 273/272 |
| 4,344,626 | A * | 8/1982 | Wadland | 273/243 |
| 4,877,405 | A * | 10/1989 | Stewart | 434/160 |
| 4,998,883 | A * | 3/1991 | Brinkley | 434/159 |
| 5,195,753 | A * | 3/1993 | Brukl et al. | 273/429 |
| 5,207,465 | A * | 5/1993 | Rich | 294/2 |
| 5,257,938 | A * | 11/1993 | Tien | 434/128 |
| 5,505,456 | A * | 4/1996 | Schmidt | 273/272 |
| 5,788,238 | A * | 8/1998 | LeBriton et al. | 273/272 |
| 5,860,653 | A * | 1/1999 | Jacobs | 273/272 |
| 6,279,911 | B1 * | 8/2001 | Cherry | 273/299 |
| 6,986,512 | B2 * | 1/2006 | Charpentier | 273/272 |
| 2001/0024974 | A1 * | 9/2001 | Cohen | 463/42 |
| 2002/0107062 | A1 * | 8/2002 | Wong | 463/9 |

FOREIGN PATENT DOCUMENTS

JP 03243980 A * 10/1991

OTHER PUBLICATIONS

Tiger Electronics, "Control Guide", 1999, Califon Productions, Inc. pp. 5-9.*
Tiger Electronics, "Control Guide", 1999,Califon Productions,Inc. pp. 5-9.*

* cited by examiner

*Primary Examiner*—Gene Kim
*Assistant Examiner*—Alyssa M Hylinski
(74) *Attorney, Agent, or Firm*—Wagner, Anderson & Bright, LLP; Roy L. Anderson

(57) ABSTRACT

A method for playing language puzzle games involving a unit of meaning in the Chinese language made up of a string of characters in which each character in the string is decomposed into radicals having from one to four strokes and all of the radicals are combined, and randomly mixed, to become a group of radicals. A player is given a category clue for the unit of meaning, the combined group of radicals and a number of characters in the string of characters, and then the player is allowed to attempt to guess the unit of meaning based upon a preselected method of revealing information relating to the combined group of radicals to the player.

4 Claims, 4 Drawing Sheets

Illustration of the decomposition of each of the four Chinese characters as shown in Figure 2 into their respective and unique radicals.

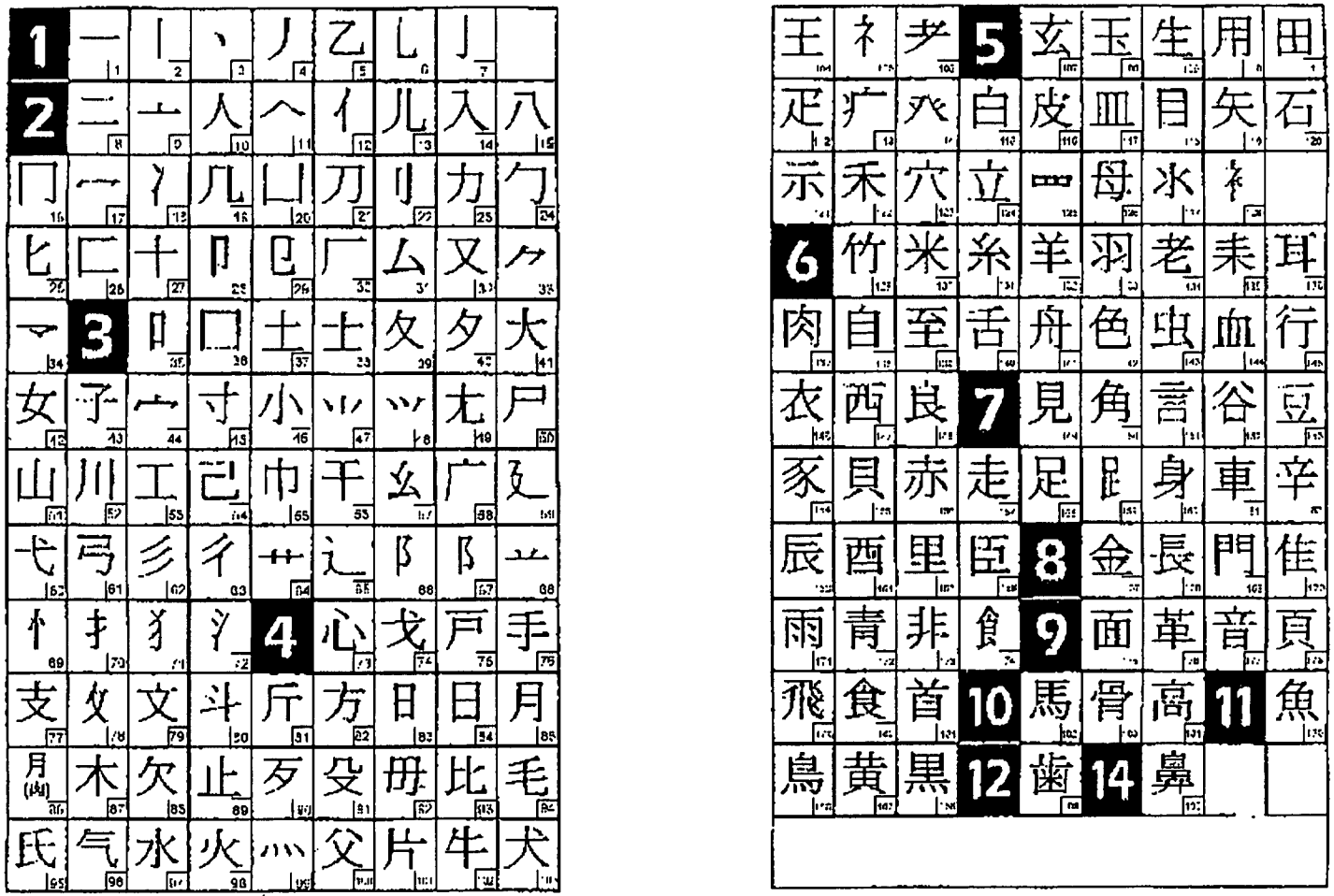
Figure 1. The Official Radical Chart selected for devising the current invention.

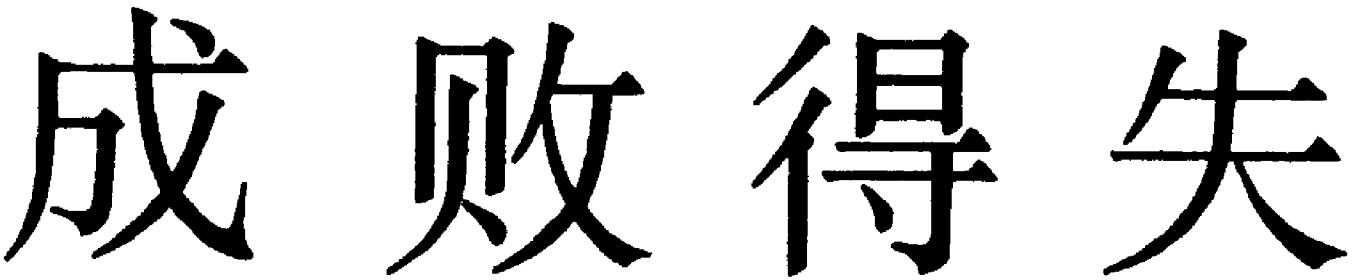
Figure 2. An example of an ensemble of four Chinese characters constituting a "Unit of Meaning".

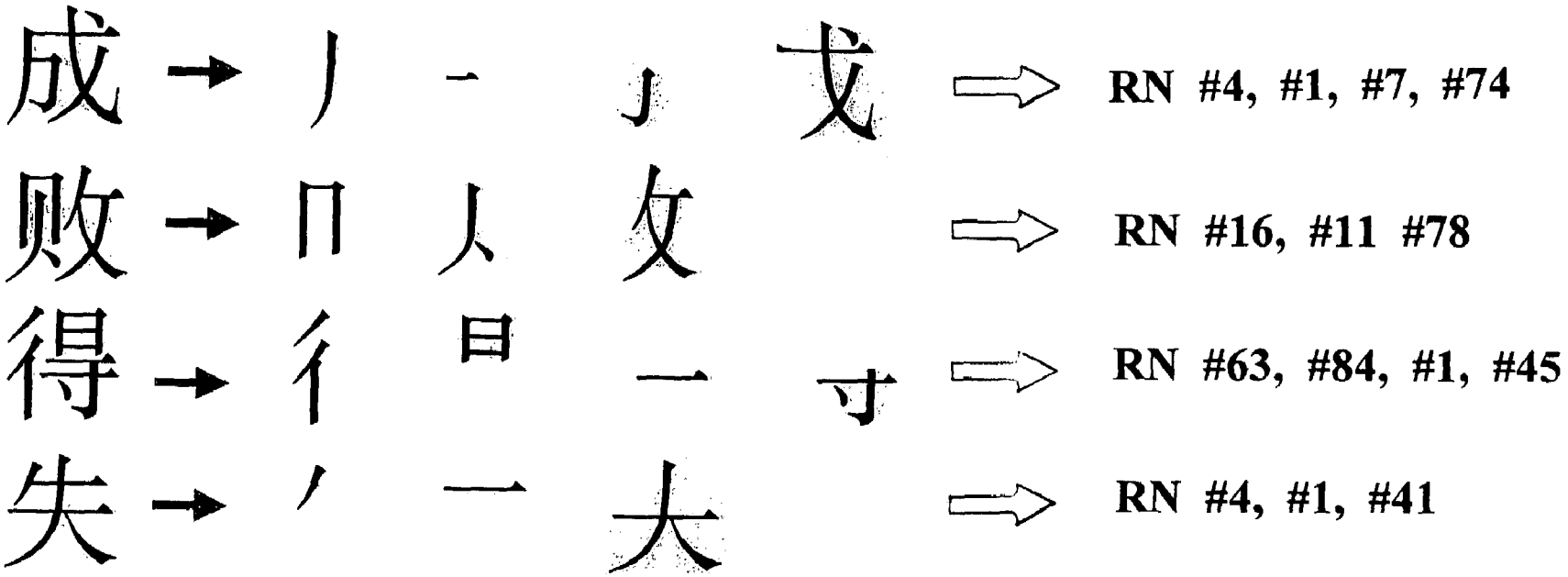
Figure 3. Illustration of the decomposition of each of the four Chinese characters as shown in Figure 2 into their respective and unique radicals.

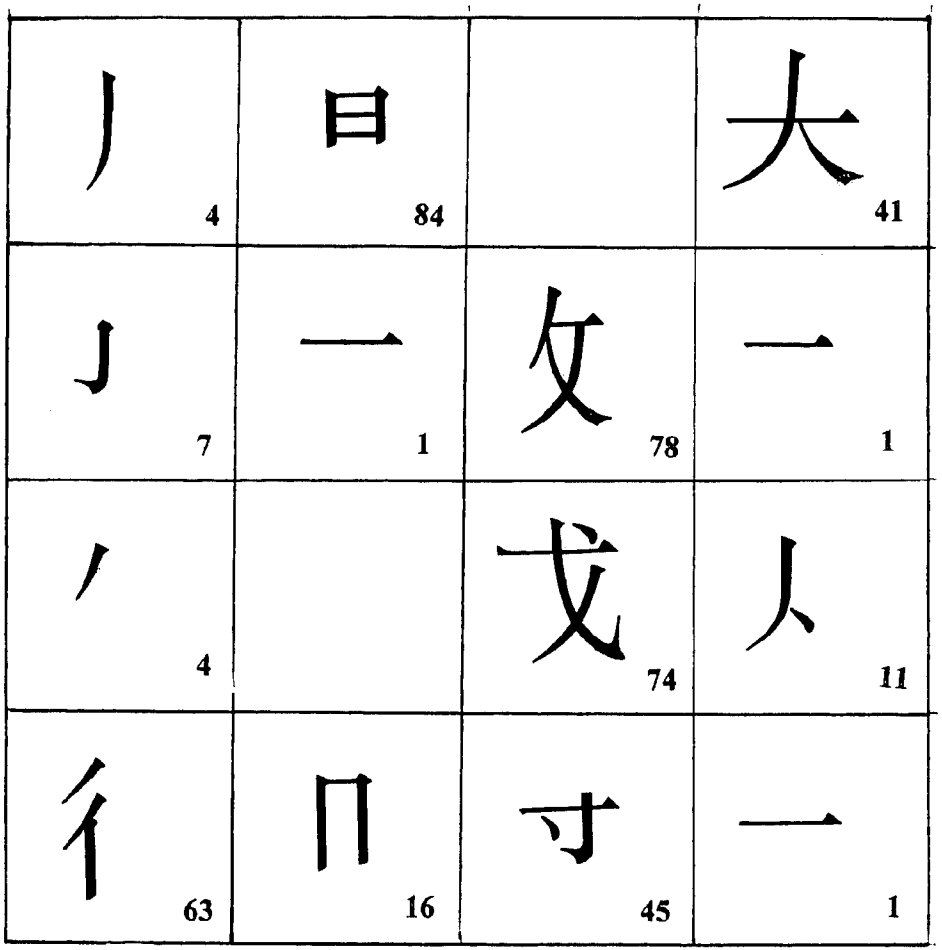
Figure 4. The 4 x 4 Clue Matrix when the ensemble of four Chinese characters shown in Figure 2 is used as a word puzzle. The 14 radicals making up the four Chinese characters are randomly dispersed as matrix elements.

METHODS FOR CHINESE RADICAL GAMES

FIELD OF THE INVENTION

This invention is in the field of language games. In particular, this invention is directed to language games using the Chinese language. This game is used both for entertaining and educating people from the very young to the very old in the learning of the language and the appreciation of Chinese culture.

BACKGROUND OF THE INVENTION

For most people living in the Western world, Chinese remains as one of the most difficult languages for them to learn and comprehend. Contrary to Japanese and Korean, which structurally speaking are no easier than Chinese, Chinese has yet to be romanized into having a Roman alphabet like the Latin languages. Thus to Westerners, Chinese remains structurally and functionally as an incoherent language as every Chinese character stands alone and bears no relationship whatsoever to other characters in spelling, pronunciation and meaning. It is interesting to note that although the major portion of the Japanese language has been Romanized, namely the Hiragana and the Katagana, the remaining 17% of the language, which comprises Kanji or Chinese characters, has not. For this reason, the Kanji part of the Japanese language remains as a major challenge for Westerners to master the language. Even native school children in Japan find the learning of Kanji especially difficult in their Japanese language curriculum.

Today in the United States where the country is literally a melting pot of people from all over the world, of different races, color, creed and cultural background, there is a trend developing among some of its citizenry, especially young children, trying to learn a second language besides their native tongue, namely English. People in the world have always attributed the greatness of the United States to its diverse cross-section of its citizens. Over time, each group of immigrants contributes its own strong character traits, cultural habits, special know-how, native customs and history to America. Almost all these immigrants and their off springs subsequently speak more than one language as they pick up English as their second language. In many parts of the United States today, especially in the Southwest, Spanish is spoken almost as frequently as English itself. It is also a well-known fact that by the year ~2025,the Caucasian American population will fall for the first time below 50%. Spanish American will constitute more than 35%, followed by Blacks of ~17% and Asians of ~10%.

It is most unfortunate, however, that among some groups of American minorities, in particular the Chinese, more and more second generation citizens, especially young adults, have pretty much abandoned the effort of learning their native tongue. There could be a number of reasons leading to this rather sad and unexpected situation. The reason that stands out the most among others is the difficulty of the language itself. Most parents of second generation Chinese American children have difficulties with the English language. Although Chinese is therefore mostly spoken at home for these children, it is a far cry from following the discipline and hard work that are needed to learn this language at home from their parents. Meanwhile these children quickly learn and master English at school. Thus the situation is not unlike what water generally does, namely to go in the direction of least resistance, or downwards. They therefore much prefer to simply speak English and forget about the Chinese language altogether.

This prevailing situation no doubt is difficult to reverse overnight, but it is by no means impossible. Nevertheless, some clever ideas have to come forward in order to convince these second generation Chinese American children not to abandon their native tongue. One of the ideas is of course through education. American societal value at large must be taught to these children. They must be told of their society's diverse mixture of inhabitants and the role that each minority group has to play in order to maintain American world leadership in so many areas as freedom, human rights, science and technology, to name just a few. They must be constantly reminded the fact that minority groups that make up the American society as a whole must contribute their special and unique cultural values back to same. Before they can do that they must first learn their native language along with their cultural background. Only through their contribution back to the American society can America continues to stay strong and be respected as a nation throughout the globe.

Another idea is to come up with tools for them to learn the language easier and with a lot of fun. Such a tool could be one or more well-thought-out language games so that they can both enjoy and learn the language as they play these games. However, despite the fact that China is now undergoing rapid modernization, and it has over one billion people, and thus is playing an increasingly important role in the global economy, its language still remains difficult to learn, and there is a long-felt need for games and methods that will help people learn the Chinese language. It is this glaring need to which the present invention is directed.

SUMMARY OF THE INVENTION

The present invention is generally directed to a method for playing language puzzle games involving a unit of meaning in the Chinese language made up of a string of characters in which each of the string of characters is decomposed into a plurality of radicals and all of the radicals are combined into a group of radicals, which is preferably randomly mixed and in which each radical only contains from one to four strokes, a player is then given a category clue for the unit of meaning, the combined group of radicals and a number of characters in the string of characters, and then the player is allowed to attempt to guess the unit of meaning based upon a preselected method of revealing information relating to the combined group of radicals to the player.

In a first, separate group of aspects of the present invention, the identity of the combined group of radicals is not initially provided to the player but the player is provided with a number of radicals for each of the string of characters. The player is then allowed to pick a radical and then its identity is revealed along with which of the string of characters include the selected radical. At this point, the player can attempt to solve the unit of meaning, or another radical can be picked. If this game is played with multiple players, the play alternates between players until the unit of meaning is solved.

In a second, separate group of aspects of the present invention, the identity of the combined group of radicals is initially provided to the player and the combined group of radicals contains a sum of radicals equal to an addition of the number of radicals needed to make up the string of characters. After a player is given a preselected amount of time, the player is allowed to attempt to identify one of the characters in the string of characters and the player is awarded points for a correctly identified character, which may be based upon the number of radicals and strokes in the radicals, and the player may be told where the character is located in the string of characters. This process is repeated until the unit of meaning is solved or, if multiple players are playing, the players can alternate between incorrect attempts to identify a character or solve the unit of meaning, and the winner is the player with the most points once the unit of meaning is solved.

In a third, separate group of aspects of the present invention, the identity of the combined group of radicals is not initially provided to the player and the combined group of radicals contains a sum of radicals equal to an addition of the number of radicals needed to make up the string of characters. A player is allowed to pick a radical from the combined group of radicals and then its identity is revealed and the player is assigned a point total, which can be based upon the number of strokes of the selected radical and the number of times the selected radical appears in the string of characters. The player is then allowed an opportunity to attempt to solve the unit of meaning. If the player cannot solve the unit of meaning, and multiple players are playing the game, the next player is allowed to choose a new radical, is assigned points for the selection, and then given an opportunity to solve the unit of meaning, and the winner is the player with the most points when the unit of meaning is solved.

Accordingly, it is a primary object of the present invention to provide an improved method for playing language puzzle games involving the Chinese language.

This and further objects and advantages will be apparent to those skilled in the art in connection with the drawings and the detailed description of the preferred embodiment set forth below.

BRIEF DESCRIPTION OF THE DRAWINGS

FIG. 1 shows an official radical chart of the Chinese language.

FIG. 2 shows an example of an ensemble of Chinese characters with a Unit of Meaning.

FIG. 3 shows an example of a word puzzle in accordance with the present invention.

FIG. 4 shows a matrix for use with a word puzzle in accordance with the present invention.

DETAILED DESCRIPTION OF THE INVENTION

Most language games, especially of Latin language origin, can generally be classified into three distinct categories described as follows. The first and the most common is the solving of a "word puzzle." Let us take the English language as an example. In this case the word puzzle comprises an ensemble of English words which has a specific meaning. It is a common practice to disclose to the players and audience ahead of time the category of meaning wherein the word puzzle belongs, the number of words in the puzzle and the number of letters in each of the puzzle words. For example, if the category is "On the Map", then one can expect that the word puzzle might be "Corpus Christi", "Glasgow" or "The Ivory Coast" etc. On the other hand, if the category is "Occupation", then one can expect that the answer might be "antique furniture restorer", "fashion designer" or "professional surfer" and so on. Before the game starts, the players and the audience will also be informed as to how many words there are in the puzzle and the number of letters each puzzle word has. Take for example the word puzzle "The Ivory Coast" belonging to the category of "On the Map" illustrated above, the players and the audience will be shown "XXX XXXXX XXXXX" as the word puzzle where each "X" represents a letter. With this word puzzle posted, players can now take turns supplying the letters (consonants or vowels) and every time a player successfully provides a letter the player is also given a chance to solve the puzzle. The game goes on until the word puzzle is correctly solved and one of the players is declared the winner.

One of the most successful language games surfaced during the past two decades is the TV game show "Wheel of Fortune" which is being played today in dozens of languages around the world. However, there is one common similarity existing among all the languages playing the popular "Wheel of Fortune" game and that is the fact that they all have an alphabet. Thus for some languages like Chinese which does not have an alphabet, the "Wheel of Fortune" game played in Chinese is not possible. However, as will be illustrated later, in accordance with the present invention, it is possible to devise a game reminiscent of the "Wheel of Fortune" language game for the Chinese language using the Chinese character constituents called "radicals".

The second category is called "Word Puzzle reconstruction." The idea here is almost exactly the opposite of the first category described above. Players and the audience again are first given the category for the word puzzle to be solved and the number of words in the puzzle. But the number of letters in each puzzle word is withheld. Players and the audience are then revealed all at once a group of letters (including consonants and vowels) the number of which is equal exactly to the number of letters contained in the word puzzle. Players are given a short period of time each and take turns to reconstruct one word at a time for the puzzle using whatever letters are available. Only completed words will be accepted. The player who correctly guesses a completed puzzle word will be awarded points according to the number of letters in the word and what manner of letters it contains. Some letters are worth more points than others. Whosoever collects the most points when all the words in the puzzle are identified wins the game.

The third category is called "Match and Score." This game resembles in a small way how the famous Scrabble® game is played but it is in essence quite different. Like the second category "Word Puzzle reconstruction," players are given the category for the word puzzle to be solved and the number of words in the puzzle. But instead of revealing all at one time the group of letters that constitute the word puzzle itself, letters are revealed to players one letter at a time. With the number of revealed letters increasing as the game goes forward, players take turns to identify one or more words from the puzzle in order to score points. Again, since some letters are worth more points than others, it will be up to the players to pick and identify words that will give them the most points. Whosoever accumulates the most points when the word puzzle is completely solved wins the game.

It is clear from the discussion above that all three categories of language games described assume the fact that the applicable languages all have an alphabet, and this is why such games cannot be played with the Chinese language, at least until the disclosure of the present invention is considered.

The current invention takes advantage of the little known fact that each and every Chinese character can be uniquely decomposed into their constituents, namely, symbols called "radicals," and the fact that every Chinese character can be dissected into a unique group of radicals is fundamental to understanding the current invention. Although there can be as many as 100,000 Chinese characters found in the Chinese National Dictionary compiled during the Ching Dynasty (1644-1911 AD), each character can be uniquely decomposed into a number of individual symbols called "radicals." These individual radicals, sequentially classified from the simplest to the most complicated, were themselves orderly compiled, based upon the number of strokes it takes to make a radical, also during the Ching Dynasty, into an official "Radical Chart." Today it is generally believed among Chinese scholars that there exists not just one official radical chart, like the one compiled during the Ching Dynasty, but a number of lesser known ones, each of which compiles all the radicals in an orderly fashion. Notwithstanding, all official radical charts are practically the same and differ from one another only to a minor extent; thus, although these charts are not the same in the minutest detail, they are all nonetheless equivalent in substance.

A typical Official Radical Chart lists almost 200 or more radicals having strokes ranging from one (1) to fourteen (14). However, because a typical Chinese character in common use comprises only around 10-20 strokes, the present invention eliminates the totally unwieldy possibility of using all the radicals in a typical Official Radical Chart for decomposing most commonly used Chinese characters and selects a more suitable Official Radical Chart for the Chinese language and analytically determines the optimum number of radicals contained therein for use, together with advancing other methodologies, in order to devise the three categories of language games described above.

FIG. 1 shows the Official Radical Chart selected for devising the current invention. This chart is published in the *Elementary Kanji Dictionary* in 2001 by Kodansha International Ltd. And Kodansha America, the disclosure of which is specifically incorporated herein by reference. Note that the total number of radicals listed in this chart is 190 starting from radicals having just one (1) stroke to the last radical having fourteen (14) strokes as shown in FIG. 1. Each radical is assigned a number starting with those having just one stroke, namely, "-" having a radical number (RN) of #1 and going horizontally and down in FIG. 1 to "八" at the end of the second row having two strokes and an RN of #15.In the same manner, radical "大" will have three strokes and RN #41 (last radical of fifth row in FIG. 1). In accordance with an especially preferred embodiment of the present invention, only the first 106 radicals, namely from radical having RN #1 to RN #106,encompassing radicals up to four strokes from the Official Radical Chart (see FIG. 1), are used. The key point, for the purpose of the preferred embodiments of the present invention, is that the radical chart used for this invention only relies upon radicals with four or less strokes.

Before one can proceed to devise the three categories of language games described earlier for the Chinese language using only the 106 radicals selected from the Official Radical Chart (see FIG. 1), one must understand a little bit about the utility structure of the Chinese language. It is commonly stated that the Chinese language has no alphabet but possesses a very large number of standalone and distinct characters. In fact, an ensemble of Chinese characters constitutes a "Unit of Meaning." An example of an ensemble of Chinese characters is shown in FIG. 2. There are four (4) Chinese characters in FIG. 2 lining up in a row. The "Unit of Meaning" of these 4 characters refers to what this ensemble of characters will convey to an observer or reader when the characters are read horizontally from left to right. On the other hand, when they are read from right to left, the four characters will literally have no meaning. Thus, it is very important to note that reading an ensemble of Chinese characters lining up in a row, it only makes sense if they are read from left to right instead of from right to left. If the Chinese characters are lined up in a column, then the "Unit of Meaning" represented by the characters is always interpreted from top to bottom without exceptions.

Each of the four Chinese characters shown in FIG. 2 can be uniquely decomposed into a number of radicals, and some of the radicals may be repeated in the same character. This can be analogized to decomposing an English word into its unique alphabetical letters (consonants and vowels) as illustrated in FIG. 3. In this figure, the first Chinese character "成" is decomposed in RN #4, #1, #7 and #74 (see FIG. 1). The second character "敗" is decomposed into RN #16, #11 and #78.The third Chinese character "得" is decomposed into RN #63, #84, #1 and #45.Finally, the fourth character "失" is decomposed into RN #4, #1 and #41.From this example, one can see that an ensemble of Chinese characters, (without limitation in number but is only four in the current example) constitutes a "Unit of Meaning" and can be equated to one or more English words, also having a "Unit of Meaning." The summation of radicals representing the four Chinese characters can be analogized to the summation of letters (consonants or vowels) that makes up the English expression comprising one or more words.

Based upon the inventive methodology outlined above, one can implement the first category of language game or "Solving a Word Puzzle" for the Chinese language as follows. Let us assume that the word puzzle is the four Chinese characters listed vertically in FIG. 3 and shown with the decomposed radicals for each character. Imagine also that there are three players playing this language game. (Note that the number of players is not a crucial consideration here.) Following the rules established, the category of meaning for the puzzle and the number of radicals for each of the Chinese characters making up the puzzle (roughly analogous to the number of letters in each word making up the puzzle for the English language) will be made known a priori to the players and they are "成語" meaning "Slang" and "XXXX XXX XXXX XXX" meaning that there are 4, 3, 4 and 3 radicals in the words of the puzzle, respectively.

Each player can now take turns to come up with a radical and then guess at the word puzzle, if desired. However, an additional methodology is also imposed in an especially preferred embodiment so this game can be played successfully for the Chinese language. The reason for the following additional methodology is that whereas there are only 26 letters (consonants and vowels) in the English alphabet (not much more for the other Latin languages) that can readily be remembered by the players to play this game, in the especially preferred embodiment, 106 radicals are used to constitute the Chinese language. Whereas the letters of the English alphabet are in common use in people's everyday life, the Chinese radicals are not. Thus, there is no reason to expect that the players will be able to remember all the 106 radicals to play this game for the Chinese language. This problem can readily be overcome by the creation of a matrix, such as a square matrix or the so-called N×N clue matrix to house all the relevant radicals. Note that the dimensions of this square matrix must be large enough to accommodate all the relevant radicals constituting the word puzzle. Take the example of the word puzzle shown in FIG. 3 which has a summation of 14 different radicals. In this case, therefore, the N×N square clue matrix must have N equal to four so that there will be 16 matrix elements. The radicals can now be randomly dispersed in the 4×4 matrix occupying 14 spaces. The other two spaces of the matrix can simply be left blank (or, alternatively, some other geometric shape or pattern can be used as a matrix to hold the requisite spaces needed for the puzzle). The 4×4 clue matrix for the word puzzle example of FIG. 3 is shown in FIG. 4 where the 14 relevant radicals are randomly dispersed.

With the 4×4 clue matrix housing all the 14 different relevant radicals, the players no longer have to remember all 106 radicals to play this "Solving the Word Puzzle" game for the Chinese language. Instead, when their turn comes up, they can simply pick any unrevealed matrix element of the 4×4 Clue Matrix to show the radical. This step might loosely be analogized to the English language counterpart when the player has to give out a letter (or buy a vowel in the "Wheel of Fortune" game). Thus, with the judicial use of the Official Radical Chart and the Clue Matrix, it is possible to play the first category of language game, namely "Solving a Word Puzzle," with the Chinese language.

To implement the second category of language games, namely "Word Puzzle reconstruction," the same Official Radical Chart which only uses from one to four strokes for each radical, as already taught, will be used. Again, using the example of a word puzzle shown in FIG. 3, players will first be notified of the word puzzle's category as "成語" meaning "Slang" and that there are four Chinese characters in this puzzle. Note that the radical-character configuration, namely "XXXX XXX XXXX XXX," is not given to the players in this case.

Before the game commences, ALL of the relevant radicals for the word puzzle to be solved will be revealed to all the players in an N×N Clue Matrix housing randomly all the radicals as shown in FIG. 4 for the current example. Also, if any radicals are duplicated, then duplicates of the same radical will also appear in the Clue Matrix. Each player will be given a certain period of time in sequential order when the player will study the N×N clue matrix and try to come up with a completed Chinese character that belongs to the word puzzle. At the end of the player's allocated time period, the player can advance a Chinese character as a trial. If such a character is not found in the word puzzle, the turn will be passed on to the next player. If the guessed Chinese character is among those in the word puzzle, the sequence position of that word in the puzzle will be revealed, again to all players. At the same time, the player will score points equal to the sum of the strokes of the radicals making up that complete Chinese character. This will go on until the entire word puzzle is correctly solved and whosoever accumulates the most points will be declared the game winner.

The final category of language games, namely "Match and Score," also uses the same Official Radical Chart which only uses from one to four strokes for each radical, as already taught. Again using the example of a word puzzle shown in FIG. 3, players will first be notified of the word puzzle's category as "成語" meaning "Slang" and that there are four Chinese Characters in this puzzle. Note that the radical-character configuration, namely "XXXX XXX XXXX XXX," is not revealed to the players in this case.

Unlike the case of the second category of language games, namely "Word Puzzle reconstruction," NOT all the relevant radicals for the word puzzle are revealed to the players all at once before the game starts. A totally covered up 4×4 clue matrix is revealed instead. As the game progresses, each player takes turns to pick a square of the clue matrix in order to expose a radical and find out how many game points or money the player can accumulate (stated in the square exposed). Like the second category of puzzle game, the clue matrix can contain duplicates of the same radical if that radical is duplicated by being repeated in more than one character or if the radical is duplicated in a single character contained in the Unit of Meaning, although a variant on this game might reveal all duplicates at the same time once one of them is chosen from the clue matrix. The accumulated points or money do not belong to the player until the player is able to solve the word puzzle. As more and more of the squares in the clue matrix are exposed and more money assigned out, players can now start to use the exposed or available radicals to form Chinese characters that the player knows. The player does not share this knowledge with the other players. The key is that a player must furnish the complete and correct word puzzle solution before the player can win all the points or money the player has accumulated throughout the game.

While the invention has been described herein with reference to certain preferred embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept. For example, although three types of general word puzzle games are described, other games could be devised. Also, although certain game rules are described, such rules could easily be changed. As one example of how the game rules might be changed, although the games are generally described as adding points for correct answers, players could begin with a set number of points and points could be subtracted from a starting total as it takes longer and more radicals are revealed, before the puzzle is solved; such a rule change could also be used in a betting game using a preselected buy-in amount with any cash-out value being based upon points (or betting units) left once the puzzle is solved. Also, the present invention describes preferred embodiments that rely upon units of meaning in which every character in its string of characters can be broken down (or decomposed) into radicals with four strokes or less. By necessity, this means that certain units of meaning, which cannot be broken down without using radicals with more than four strokes, cannot be used with the games described herein; however, one might choose to use an advanced or super hard version of one of the disclosed games in which radicals with more than four strokes are used. Or, similarly, one could play a simplified version of one of the disclosed games in which all characters could be broken down to radicals with less than four strokes, although this is far from preferred.

Accordingly, it will be apparent to those skilled in the art that still further changes and modifications in the actual concepts described herein can readily be made without departing from the spirit and scope of the disclosed inventions as defined by the following claims.

What is claimed is:

1. A method for playing a language puzzle game involving the Chinese language, comprising the steps of:

selecting a unit of meaning in the Chinese language comprised of a string of characters;

decomposing each of the string of characters into a plurality of radicals and combining each radical of each of the plurality of radicals into a combined group of radicals;

providing a player with a category clue for the unit of meaning;

providing the player with the combined group of radicals and a number of characters in the string of characters; and allowing the player to attempt to guess the unit of meaning based upon a preselected method of revealing information relating to the combined group of radicals to the player;

wherein each of the combined group of radicals consists of from one to four strokes;

wherein the identity of the combined group of radicals is initially provided to the player and the combined group of radicals contains a sum of radicals equal to an addition of the number of radicals contained in each of the plurality of radicals for the string of characters;

wherein the preselected method of revealing information is comprised of the steps of:

(1) giving the player a preselected amount of time;

(2) allowing the player to attempt to identify one of the characters in the string of characters;

(3) awarding the player with points for a correctly identified character contained within the string of characters; and (4) repeating steps (1) through (3) until the player solves the unit of meaning; and wherein the points awarded in step (3) are equal to the sum of the strokes of the radicals that make up the correctly identified character.

2. A method for playing a language puzzle game involving the Chinese language, comprising the steps of:

selecting a unit of meaning in the Chinese language comprised of a string of characters;

decomposing each of the string of characters into a plurality of radicals and combining each radical of each of the plurality of radicals into a combined group of radicals;

providing a player with a category clue for the unit of meaning;

providing the player with the combined group of radicals and a number of characters in the string of characters; and allowing the player to attempt to guess the unit of meaning based upon a preselected method of revealing information relating to the combined group of radicals to the player;

wherein each of the combined group of radicals consists of from one to four strokes;

wherein the identity of the combined group of radicals is initially provided to the player and the combined group of radicals contains a sum of radicals equal to an addition of the number of radicals contained in each of the plurality of radicals for the string of characters;

wherein the preselected method of revealing information is comprised of the steps of:

(1) giving the player a preselected amount of time;

(2) allowing the player to attempt to identify one of the characters in the string of characters;

(3) awarding the player with points for a correctly identified character contained within the string of characters; and (4) repeating steps (1) through (3) until the player solves the unit of meaning;

wherein the game is played by two or more players;

wherein the preselected method of revealing information is further comprised of the steps of:

(1) selecting one of the players as an active player;

(2) giving the active player a preselected amount of time;

(3) allowing the active player to attempt to identify one of the characters in the string of characters;

(4) if the active player does not identify a correctly identified character contained in the string of characters, then selecting a different player as the active player; and (5) if the active player identifies a correctly identified character, then awarding the active player with points for the correctly identified character and either allowing the active player to repeat steps (2) through (5) if the unit of meaning has not been solved or determining a game winner based upon which of the two or more players has the most points; and the following additional step is included as part of step (5): revealing a sequence location for the correct identification in the string of characters;

wherein the points awarded in step (5) are equal to the sum of the strokes of the radicals that make up the correctly identified character.

3. A method for playing a language puzzle game involving the Chinese language, comprising the steps of:

selecting a unit of meaning in the Chinese language comprised of a string of characters;

decomposing each of the string of characters into a plurality of radicals and combining each radical of each of the plurality of radicals into a combined group of radicals;

providing a player with a category clue for the unit of meaning;

providing the player with the combined group of radicals and a number of characters in the string of characters; and allowing the player to attempt to guess the unit of meaning based upon a preselected method of revealing information relating to the combined group of radicals to the player;

wherein each of the combined group of radicals consists of from one to four strokes;

wherein the identity of the combined group of radicals is not initially provided to the player and the combined group of radicals contains a sum of radicals equal to an addition of the number of radicals contained in each of the plurality of radicals for the string of characters; and wherein the preselected method of revealing information is comprised of the steps of:

(1) allowing the player to pick a selected radical from the combined group of radicals;

(2) revealing the identity of the selected radical to the player and assigning the player a point total based upon the number of strokes of the selected radical and the number of times the selected radical appears in the string of characters;

(3) allowing the player to attempt to solve the unit of meaning; and (4) repeating steps (1) through (3) until the player solves the unit of meaning.

4. A method for playing a language puzzle game involving the Chinese language, comprising the steps of:

selecting a unit of meaning in the Chinese language comprised of a string of characters;

decomposing each of the string of characters into a plurality of radicals and combining each radical of each of the plurality of radicals into a combined group of radicals;

providing a player with a category clue for the unit of meaning;

providing the player with the combined group of radicals and a number of characters in the string of characters; and allowing the player to attempt to guess the unit of meaning based upon a preselected method of revealing information relating to the combined group of radicals to the player;

wherein each of the combined group of radicals consists of from one to four strokes;

wherein the identity of the combined group of radicals is not initially provided to the player and the combined group of radicals contains a sum of radicals equal to an addition of the number of radicals contained in each of the plurality of radicals for the string of characters;

wherein the game is played by two or more players;

wherein the preselected method of revealing information is comprised of the steps of:

(1) selecting one of the players as an active player;

(2) allowing the active player to pick a selected radical from the combined group of radicals;

(3) revealing the identity of the selected radical and assigning the active player a point total based the selected radical;

(4) allowing the player to attempt to solve the unit of meaning;

(5) if the active player does not solve the unit of meaning, then selecting a different player as the active player;

(6) repeating steps (1) through (5) until the active player solves the unit of meaning and becomes a winning player; and (7) awarding the winning player with all the point totals the winning player has accumulated as the active player during steps (1) through (6); and wherein the point total assigned in step (3) is based upon the number of strokes of the selected radical and the number of time the selected radical appears in the string of characters.

* * * * *